US005162968A

United States Patent [19]

Neiger

[11] Patent Number: 5,162,968

[45] Date of Patent: Nov. 10, 1992

[54] FIBER OPTIC WIRING CONTROL SYSTEM

[75] Inventor: Benjamin B. Neiger, Floral Park, N.Y.

[73] Assignee: Leviton Manufacturing Company, Inc., Little Neck, N.Y.

[21] Appl. No.: 758,186

[22] Filed: Sep. 12, 1991

Related U.S. Application Data

[63] Continuation of Ser. No. 676,671, Mar. 28, 1991, abandoned, which is a continuation of Ser. No. 561,858, Aug. 19, 1990, abandoned, which is a continuation of Ser. No. 419,121, Oct. 10, 1989, abandoned, which is a continuation of Ser. No. 269,530, Nov. 9, 1988, abandoned, which is a continuation of Ser. No. 131,707, Dec. 7, 1987, abandoned, which is a continuation of Ser. No. 55,399, May 29, 1987, abandoned, which is a continuation of Ser. No. 926,924, Oct. 27, 1986, Pat. No. 4,704,656.

[51] Int. Cl.[5] ..... H01H 47/24

[52] U.S. Cl. ..... 361/173; 307/117; 359/225

[58] Field of Search ..... 323/353, 902; 361/173, 361/174; 350/486; 307/117, 140; 250/221, 234

[56] References Cited

U.S. PATENT DOCUMENTS

| | | | |
|---|---|---|---|
| 3,087,066 | 4/1963 | Keogh, Jr. | 361/173 X |
| 3,800,160 | 3/1974 | Ishizawa et al. | 250/234 X |
| 3,881,106 | 4/1975 | Pocker et al. | 250/234 |
| 3,931,514 | 1/1976 | Patterson | 307/117 X |
| 4,324,981 | 4/1982 | Miller | 250/551 |
| 4,352,046 | 9/1982 | Tigner et al. | 307/117 X |
| 4,704,656 | 11/1987 | Neiger | 361/173 |

*Primary Examiner*—Marc Hoff
*Attorney, Agent, or Firm*—Paul J. Sutton

[57] ABSTRACT

The present invention teaches a control system wherein fiber optics controls the functioning of one or more types of wiring devices, such as a wall receptacle. With the use of the present invention, a relatively safer system is provided for use in wet, hospital, explosive and other environments, and which is capable of surface mounting. Switch and load supply assemblies are interconnected by fiber optic means for transmitting reflected signals from a movable mirror to a photocell-influenced relay circuit.

9 Claims, 1 Drawing Sheet

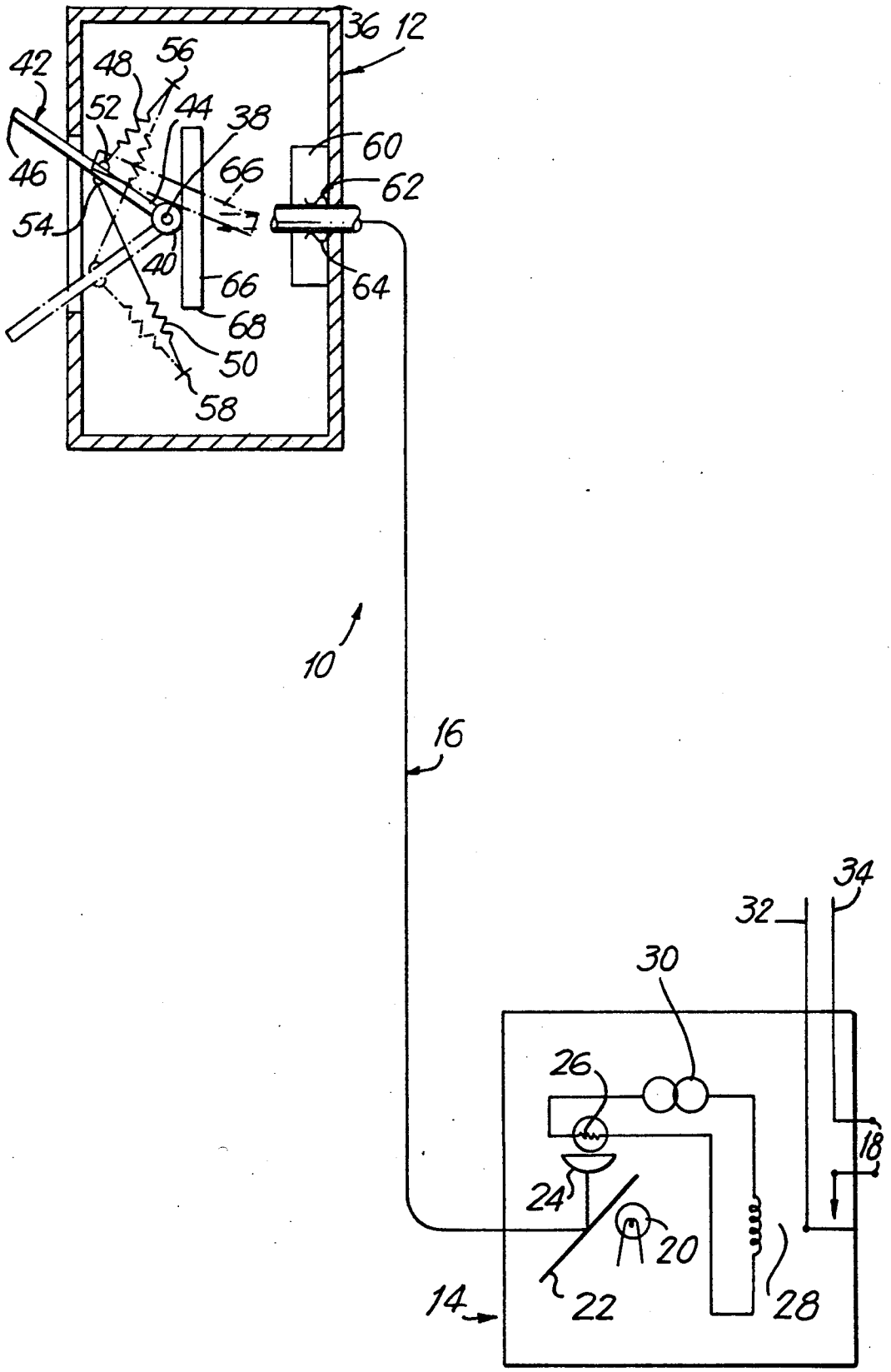
36
12
42
48
56
52
44
38
60
46
66
62
54
40
66
64
68
50
58
10
16
34
32
30
26
18
24
20
22
28
14

FIBER OPTIC WIRING CONTROL SYSTEM

This application is a continuation of Ser. No. 07/676,671 filed Mar. 28, 1991 now abandoned. Ser. No. 07/676,671 is a continuation of Ser. No. 07/561,858 filed Aug. 1, 1990 and now abandoned. Ser. No. 07/561,858 is a continuation of Ser. No. 419,121, filed Oct. 10, 1989 and now abandoned. Ser. No. 07/419,421 is a continuation of Ser. No. 07/269,530, filed Nov. 9, 1988 now abandoned. Ser. No. 07/269,530 is a continuation of Ser. No. 07/131,707, filed Dec. 11, 1987 and now abandoned. Ser. No. 07/137,707, is a continuation of Ser. No. 07/055,399 filed May 29, 1987 and now abandoned. Ser. No. 07/055,399 is a continuation of Ser. No. 06/926,924, filed Oct. 27, 1986 and issued as U.S. Pat. No. 4,704,656, on Nov. 3, 1987.

BACKGROUND OF THE INVENTION

Conventional or prior art electrical switches in use today are of constructions which require copper or conductive electrical wires from the load to the switch, wherein arcing normally plays a role in the life of electrical contacts within the wiring device. This arcing presents an environment wherein fire or explosion within a combustive atmosphere is a danger. In addition, the arcing generates noise in radios, televisions, instruments, or the like. Loose electrical connections due to faulty installation can cause overheating and possible fire and, absent relatively large and unattractive conduits, the wires are not normally surface mounted, such as over a wall or ceiling surface. Such wiring also carries with it a measurable voltage drop where relatively long lengths of wire are involved.

SUMMARY OF THE INVENTION

It is an object of the present invention to meet these needs, and to provide a system for controlling one or more wiring devices, or the like.

It is another object of the present invention to provide such a system which is capable of mounting upon the surface of a wall and ceiling, rather than within same.

It is a further object of this invention to provide such a system wherein a completely safe environment is made available to the user, and wherein there is virtually no electricity at the novel switch assembly according to the present invention, thereby eliminating any danger of shock or electrocution, even near or under water.

Yet another object of this invention is to provide such a system, wherein switching of electrical wiring devices is accomplished without electrical wires, thereby eliminating sparks, heat at the switch, fire and other related hazards.

A further object of the present invention is to provide such a system, wherein a novel switching assembly is independent of the voltage of the devices being controlled, such that the same switch assembly may turn on and off devices which carry thousands of volts and amperes or only millivolts and micro-amperes.

BRIEF DESCRIPTION OF THE DRAWING

Other objects of the present invention will become apparent to the reader from the present specification, read in conjunction with the claims and drawing, wherein similar reference characters denote similar elements, and wherein:

The drawing is a schematic representation and partial fragmentary sectional elevational view of the system according to the present invention.

DETAILED DESCRIPTION OF THE INVENTION

This invention meets the foregoing objectives and solves the problems associated with conventional devices by providing a system for controlling wiring devices, or the like, comprising a load supply assembly and a switch assembly, these assemblies being interconnected by a fiber optic cable. The load supply assembly includes a support housing, a source of light located within this housing, a photoelectric sensor and relay means responsive to the photoelectric sensor for closing a current carrying circuit. The switch assembly includes a switch housing, a reflective surface such as a mirror movably supported within the switch housing, and toggle mechanism for moving the mirror between on and off positions. Light generated by the source of light is transmitted from the load supply assembly through the fiber optic cable to the switch assembly wherein, with the reflective surface or mirror in the on position, this transmitted light is reflected back through a fiber optic cable to the photoelectric sensor which, in turn, causes power to be supplied to the load.

Referring now in more detail to the drawing, a system 10 according to the present invention includes a switch assembly 12 and a load supply assembly 14 coupled or interconnected by a fiber optic cable 16. Load supply assembly 14 supplies power "out" to an electrical load (not shown) via terminals 18, the electrical load being any one or more of a variety of wiring devices including, without limitation, a wall receptacle or a lamp socket. A relatively small source of light 20, such as a light emitting diode (LED), neon lamp or incandescent lamp, is supported within load supply assembly 14 opposite a relatively lower side of light transmitting (two way) mirror 22 supported at a 45 degree angle. A lens 24 is located between mirror 22 and a photoelectric cell 26, which itself is in series with a relay 28 supplied with power through supply 30. Phase and neutral lines 32 and 34, respectively, are shown leading to load supply assembly 14.

Switch assembly 12 includes a housing 36 which supports a pivot rod 38 which, in turn, supports a hub 40 for pivotal movement between an "on" position shown in full lines in the drawing, and an "off" position shown in phantom lines within the same drawing. This pivotal movement is facilitated by means of a lever 42 connected to hub 40 at an inner end 44. The opposite outer end 46 of lever 42 protrudes from housing 36 to a position within reach of the hand of a user. In a preferred embodiment of the present invention, a pair of springs 48 and 50 are anchored to lever 42 substantially mid-length at anchor points 52 and 54, respectively, and to their respective housing anchor points 56 and 58, such that the position of lever 42 is controlled and maintained. In this way, an over-center type control of lever 42 may be realized or simply an arrangement where lever 42 occupies either an "on" position as shown in full lines in the drawing, or an "off" position as shown in phantom or broken lines.

Means for holding the ends of fiber optic cable 16 to and within housing 36 include a retainer plate 60 within which a resilient cable retainer clip 62 is situated, with resilient fingers 64 able to engage and hold cable 16 in the position shown, with its end held substantially normal or perpendicular with respect to the surface 66 of a mirror 68 integral at its midsection with hub 40.

Fiber optic cable 16 may be of a single light-transmitting conduit, or may consist of two or more such light-transmitting paths. What is required according to the present invention is that light be capable of transmission between the load supply assembly 14 to the switch assembly 12 and back to the load supply assembly, as will be more fully understood from the following description of the operatin of the present invention.

In operation, light emitted from source 20 reaches the end of fiber optic cable 16 at the load supply assembly and is transmitted through cable 16 to its opposite end held by fingers 64 of clip 62. This light "hits" surface 66 of mirror 68 and is reflected back to cable 16, which transmits the reflected light to the reflective surface of mirror 22. Mirror 22 reflects this light being returned from switch assembly 12 toward lens 24, which focuses and, optionally, magnifies same. The light from lens 24 is focused upon photoelectric cell 26 which becomes conductive, thereby permitting current from relay power supply 30 to energize relay 28 which, in turn, causes a switching "on" of power from lines 32 and 34 to the output terminals 18 of the load supply assembly 14.

Upon the user moving lever 42 from the "on" position shown in full lines in the drawing to the "off" position shown in broken or phantom lines, light carried from source 20 to switch assembly 12 by cable 16 is not reflected back to the load supply assembly and, thus, without a supply of light to photoelectric cell 26, the cell becomes non-conductive, causing an opening of relay 28 with a resulting "breaking" of the supply of power to terminals 18 and any device electrically connected thereto, such as lighting. Cell 26 may be a device such as a selenium cell, a cadmium sulfide cell, a photovoltaic silicone cell or other photo-sensitive semiconductor.

Thus, the user may toggle switch assembly 12 for the desired result—without the need for electrically conductive wires, arcing, heat, fires, electric shock, voltage drops, etc.. While the relay 28 has been illustrated in the form of an electro-mechanical relay, it is contemplated by the present invention for this device 28 to be a solenoid or a solid state device, such as a transistor, silicone controlled rectifier, triac, FET, or other suitable means.

The present invention further contemplates the ability of the user to surface mount cable 16 upon the ceiling or walls of rooms.

The embodiments of the present invention illustrated and described are presented merely as examples of the invention. Other forms, embodiments and examples of this invention coming within the proper scope of the appended claims will readily suggest themselves to those skilled in the art.

What is claimed is:

1. A system for controlling a wiring device or the like, said system comprising:

a fiber optic cable;

a source of light located proximate to one end of said cable for transmitting light through said cable;

a member having a light reflecting surface located proximate to the other end of said cable, said member being movable to and from a position where said light reflecting surface reflects light transmitted through said cable from said source back through said cable;

photoelectric means located proximate to said one end of said cable and functioning to convert light reflected from said light reflecting surface through said fiber optic cable to an electrical signal; and means responsive to said electrical signal for closing a current carrying circuit.

2. The system of claim 1 further comprising means for moving said light reflecting surface to and from said position.

3. The system of claim 2 wherein said means for moving said light reflecting surface comprises a supported pivot rod, a hub supported by said pivot rod for pivotal movement, said member being connected to said hub such that it moves as said hub pivotally moves, and a lever connected at one end thereof to said hub such that movement of said lever causes said hub to pivotally move.

4. The system of claim 3 further comprising a pair of springs each anchored at one end thereof and connected to said lever at the other end thereof such that the position of said lever is controlled and maintained.

5. The system of claim 1 further comprising a mirror disposed between said source of light and said fiber optic cable, said mirror being capable of transmitting light therethrough.

6. The system of claim 5 wherein said mirror allows light from said source to reach said fiber optic cable and reflects light transmitted back from said member towards said photoelectric means.

7. The system of claim 6 further comprising a lens situated between said member and said photoelectric means.

8. The system of claim 1 wherein said means responsive to said electrical signal comprises a relay.

9. The system of claim 1 wherein said current carrying circuit comprises power output conductors capable of supplying power when said member is in said position.

* * * * *